US009819073B2

(12) United States Patent
Park et al.

(10) Patent No.: US 9,819,073 B2
(45) Date of Patent: Nov. 14, 2017

(54) ELECTRONIC APPARATUS INCLUDING ANTENNA DEVICE

(71) Applicant: Samsung Electronics Co., Ltd., Gyeonggi-do (KR)

(72) Inventors: Hoon Park, Seoul (KR); Yeon-Woo Kim, Seoul (KR); Ho-Saeng Kim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/216,379

(22) Filed: Jul. 21, 2016

(65) Prior Publication Data

US 2016/0329629 A1 Nov. 10, 2016

Related U.S. Application Data

(63) Continuation of application No. 14/532,235, filed on Nov. 4, 2014, now Pat. No. 9,413,080.

(30) Foreign Application Priority Data

Nov. 4, 2013 (KR) ..... 10-2013-0133221

(51) Int. Cl.

| | |
|---|---|
| ***H01Q 1/24*** | (2006.01) |
| ***H01Q 1/38*** | (2006.01) |
| ***H01Q 21/30*** | (2006.01) |
| ***H01Q 9/42*** | (2006.01) |
| ***H01Q 7/00*** | (2006.01) |

(52) U.S. Cl.

CPC ..... *H01Q 1/243* (2013.01); *H01Q 7/00* (2013.01); *H01Q 9/42* (2013.01); *H01Q 21/30* (2013.01)

(58) Field of Classification Search

CPC ..... H01Q 1/243; H01Q 21/30; H01Q 7/00; H01Q 9/42; H01Q 1/12; H01Q 1/38

See application file for complete search history.

(56) References Cited

U.S. PATENT DOCUMENTS

| | | | | |
|---|---|---|---|---|
| 5,386,214 A | 1/1995 | Sugawara | | |
| 6,424,300 B1 * | 7/2002 | Sanford | ..... | H01Q 1/243 343/700 MS |

(Continued)

FOREIGN PATENT DOCUMENTS

| | | |
|---|---|---|
| KR | 1020080008687 | 1/2008 |
| KR | 1020100060796 | 6/2010 |
| KR | 1020120047711 | 5/2012 |

*Primary Examiner* — Tho G Phan

(74) *Attorney, Agent, or Firm* — The Farrell Law Firm, P.C.

(57) ABSTRACT

An electronic apparatus is provided. The electronic apparatus includes at least one first antenna radiator, a main board including a feed part that is spaced apart from at least one portion of the at least one first antenna radiator to overlap the at least one portion of the at least one first antenna radiator and feeds an electric current to the at least one first antenna radiator according to an indirect feed method, at least one second antenna radiator disposed on a housing of the electronic apparatus, at least one first connection member for electrically connecting the at least one first antenna radiator to the at least one second antenna radiator, and at least one second connection member for electrically connecting a ground part formed on the main board to the at least one second antenna radiator. Also, other various exemplary may be implemented.

18 Claims, 16 Drawing Sheets

(56) References Cited

U.S. PATENT DOCUMENTS

| | | | | |
|---|---|---|---|---|
| 6,570,538 | B2 | 5/2003 | Vaisanen | |
| 7,830,317 | B2 * | 11/2010 | Yamazaki | G06F 1/1616 343/702 |
| 8,395,555 | B2 | 3/2013 | Hobson | |
| 9,024,823 | B2 | 5/2015 | Bevelacqua | |
| 9,413,080 | B2 * | 8/2016 | Park | H01Q 1/243 |
| 9,653,780 | B2 * | 5/2017 | Chen | H01Q 1/243 |
| 9,653,783 | B2 * | 5/2017 | Nickel | H01Q 1/243 |
| 2003/0207701 | A1 | 11/2003 | Rolnik et al. | |
| 2011/0260931 | A1 | 10/2011 | Tsai | |
| 2013/0057437 | A1 | 3/2013 | Chiu et al. | |
| 2014/0266922 | A1 * | 9/2014 | Jin | H01Q 21/28 343/702 |
| 2014/0266923 | A1 * | 9/2014 | Zhou | H01Q 5/35 343/702 |
| 2014/0354491 | A1 * | 12/2014 | Kim | H01Q 1/243 343/702 |

* cited by examiner

ELECTRONIC APPARATUS INCLUDING ANTENNA DEVICE

PRIORITY

This application is a Continuation Application of U.S. patent application Ser. No. 14/532,235, filed in the U.S. Patent and Trademark Office on Nov. 4, 2014, which claims priority under 35 U.S.C. §119 to a Korean Patent Application filed in the Korean Intellectual Property Office on Nov. 4, 2013 and assigned Serial No. 10-2013-0133221, the contents of which are incorporated herein by reference.

BACKGROUND

1. Field of the Invention

The present invention relates generally to an electronic apparatus including an antenna device capable of improving an antenna performance.

2. Description of the Related Art

With the development of electronic communication industry, user devices (e.g., electronic devices such as cellular phones, electronic schedulers, personal convergence terminals, and laptop computers) help users work through a graphical user interface (GUI) environment using a touch screen and provide various web-based multimedia.

In addition, user devices are provided with various electronic parts for providing various functions. For example, a communication module may be installed on a user device to communicate with an electronic device through a network.

SUMMARY

The present invention has been made to address at least the above problems and disadvantages, and to provide at least the advantages described below. Accordingly, an aspect of the present invention is to provide an electronic apparatus including an antenna device for ensuring an antenna performance.

Another aspect of the present invention is to provide an electronic apparatus including an antenna device, so that the electronic apparatus may be light weight, thin, simple, and small.

In accordance with an aspect of the present invention, an electronic apparatus is provided, which includes at least one first antenna radiator; a main board including a feed part that is spaced apart from at least one portion of the at least one first antenna radiator to overlap the at least one portion of the at least one first antenna radiator and feeds an electric current to the at least one first antenna radiator according to an indirect feed method; at least one second antenna radiator disposed on a housing forming an appearance of the electronic apparatus; at least one first connection member for electrically connecting the at least one first antenna radiator to the at least one second antenna radiator; and at least one second connection member for electrically connecting a ground part formed on the main board to the at least one second antenna radiator.

In accordance with another aspect of the present invention, an electronic apparatus is provided, which includes a mounting plate including at least one metal part; a rear case coupled to the mounting plate; a battery cover coupled to the rear case; a main circuit board disposed between the mounting plate and the rear case; a sub circuit board received in the mounting plate and electrically connected to the main circuit board; an antenna radiator disposed between the mounting plate and the rear case; at least one first connection member for electrically connecting the at least one metal part to the antenna radiator; at least one second connection member for electrically connecting the at least one metal part to a ground part formed on the main circuit board; and a feed part extending from the main circuit board and disposed between at least one portion of the antenna radiator and at least one portion of the sub circuit board. The antenna radiator and the at least one metal part indirectly receive an electric current from the feed part and resonate to transmit and receive a signal of first frequency band, and at least one portion of the sub circuit board indirectly receives an electric current from the feed part and resonates to receive and transmit and receive a signal of second frequency band.

BRIEF DESCRIPTION OF THE DRAWINGS

The above and other aspects, features and advantages of the present invention will be apparent from the following description, taken in conjunction with the accompanying drawings, in which, like reference numerals represent like parts.

DETAILED DESCRIPTION OF EMBODIMENTS OF THE PRESENT INVENTION

Figure 1:
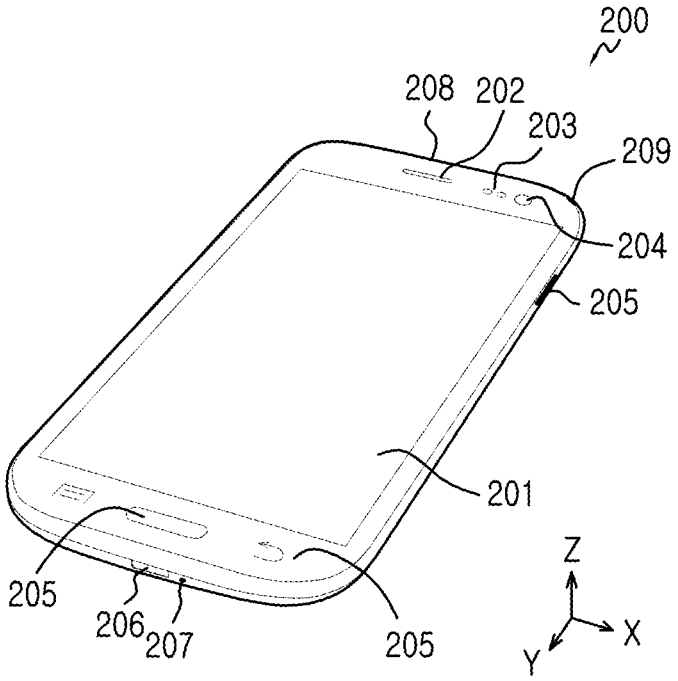
FIG. 1 illustrates a perspective view of an electronic apparatus according to an embodiment of the present invention.

The following description with reference to the accompanying drawings is provided to assist in a comprehensive understanding of embodiments of the invention as defined by the claims and their equivalents. It includes various specific details to assist in that understanding but these are to be regarded merely as examples. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the meanings in a dictionary, but, are merely used to enable a clear and consistent understanding of the present invention. Accordingly, it should be apparent to those skilled in the art that the following description of embodiments of the present invention is provided for illustration purposes only and not for the purpose of limiting the present invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations, and other factors known to those of skill in the art, may occur in amounts that do not preclude the effect the characteristic was intended to provide.

The terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

An electronic apparatus according to an embodiment of the present invention may have a communication function. For example, the electronic apparatus includes at least one of a smart phone, a tablet personal computer (PC), a mobile phone, a video phone, an e-book reader, a desktop PC, a personal digital assistant (PDA), a portable multimedia player (PMP), an MP3 player, a mobile medical device, a camera, and a wearable device (e.g., a head-mounted-device (HMD) such as electronic eyeglasses, electronic clothes, an electronic bracelet, an electronic necklace, an electronic accessory, or a smart watch).

According to an embodiment of the present invention, an electronic apparatus may be a smart home appliance having a communication function. For example, the smart home appliance includes at least one of a television, a digital video disk (DVD) player, an audio system, a refrigerator, an air conditioner, a cleaner, an oven, a microwave oven, a washing machine, an air cleaner, a set-top box, a TV box (e.g., Samsung HomeSync™, Apple TV™, or Google TV™), a game console, an electronic dictionary, a camcorder, and an electronic picture frame.

According to an embodiment of the present invention, an electronic apparatus may include at least one of various medical devices (e.g., a magnetic resonance angiography (MRA) device, a magnetic resonance imaging (MRI) device, a computed tomography (CT) device, an image capturing device, and an ultrasonic device), a navigation device, a global positioning system (GPS) receiver, an event data recorder (EDR), a flight data recorder (FDR), a vehicle infotainment device, an electronic apparatus for a ship (e.g., a ship navigation device or a gyrocompass), an avionics device, and a security device.

According to an embodiment of the present invention, an electronic apparatus may include at least one of furniture, a portion of a building/structure, an electronic board, an electronic signature receiving device, a projector, and various measuring devices (e.g., devices for measuring tap water, electricity, gas, or a radio wave), which have a communication function. An electronic apparatus according to an embodiment of the present invention may be at least one combination of the above-described various devices. Furthermore, it would be obvious to a person skilled in the art that the electronic apparatuses according to an embodiment of the present invention are not limited to the above-described various devices.

FIG. 1 illustrates a perspective view of an electronic apparatus according to an embodiment of the present invention.

Referring to FIG. 1, an electronic apparatus 200 includes a touch screen 201, a speaker 202, at least one sensor 203, a camera 204, at least one key 205, an external port 206, a microphone 207, a jack 208, or an antenna 209.

The touch screen 201 displays an image and receives a touch input. The touch screen 201 may include a display, a touch panel, and a pen sensor (e.g., a digitizer).

The speaker 202 outputs an electrical signal into a sound.

The at least one sensor 203 measures a physical quantity or senses an operation state of the electronic apparatus 200 to convert measured or sensed information into an electrical signal. The at least one sensor 203 may be mounted in a specific location. The at least one sensor 203 may include at least one of a gesture sensor, a proximity sensor, a grip sensor, a gyro sensor, an acceleration sensor, a geomagnetic sensor, a pressure sensor, a temperature/humidity sensor, a hall sensor, a red/green/blue (RGB) sensor, an illumination sensor, a biometric sensor, and an ultra violet (UV) sensor.

The camera 204 captures a still image and a moving image and may include one or more image sensors, an image signal processor (ISP), or a flash LED.

The key 205 may include a press key or a touch key. The key 205 may include a key for adjusting a volume or a key for turning power on or off.

The external port 206 (e.g., a socket) may be used as a charging port or a port that is connected to a high-definition multimedia interface (HDMI), a universal serial bus (USB), a projector, or a D-subminiature (D-sub) cable.

The microphone 207 converts a sound into an electrical signal.

The jack 208 may be electrically connected to a plug of an ear phone or an ear set. When the jack 208 is not used, the jack 208 may be covered with a cover.

The antenna 209 (e.g., a digital multimedia broadcasting (DMB) antenna) may be pulled out of the electronic apparatus 200 and be extended.

Figure 2:
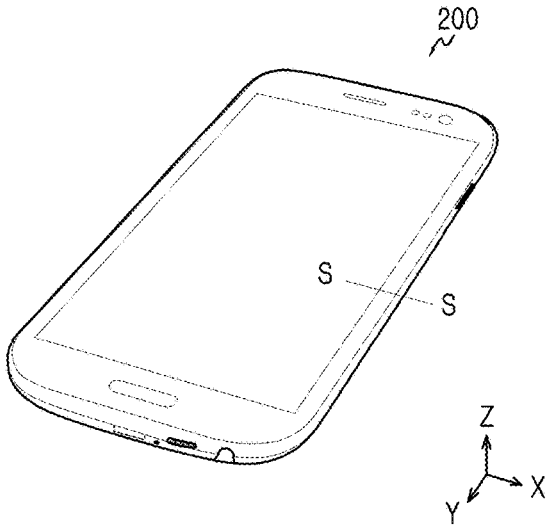
FIG. 2 illustrates a partial cross-sectional view taken along line S-S of an electronic apparatus according to an embodiment of the present invention.
Figure 2:
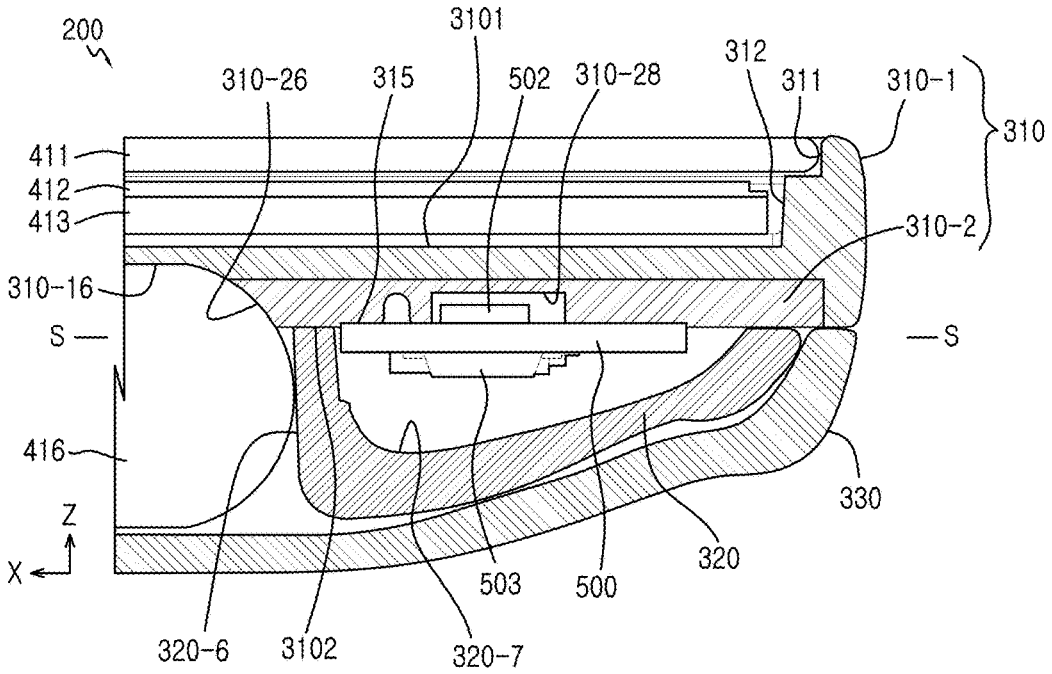

FIG. 2 illustrates a partial cross-sectional view taken along line S-S of an electronic apparatus according to an embodiment of the present invention. Referring to FIG. 2, a window 411, a touch panel 412, a display panel 413, a battery 416, a bracket 310, a rear case 320, a battery cover 330, and a main circuit board 500 are disposed in a portion S-S.

The window 411 may be transparent and is disposed above the touch panel 412 and transmits an image from the display panel 413 to the outside.

The touch panel 412 may be disposed beneath the window 411 and is used to detecting a touch input. One of a capacitive method, a decompression method, an infrared method, and an ultrasonic method may be applied to the touch panel 412. The main circuit board 500 receives a touch input from the touch panel 412.

The display panel 413 is disposed under the touch panel 412. The display panel 413 displays an image converted from a signal transmitted from the main circuit board 500. The display panel 413 may include a liquid crystal display (LCD) or an active matrix-organic light emitting diode (AM-OLED). The display panel 413 may be flexible. The display panel 413 and the touch panel 412 may be formed into a module. The display panel 413, the window 411, and the touch panel 412 may be formed into a module (e.g., a touch screen).

The bracket 310 is a mounting plate (an installation plate) on which a plurality of electronic parts are installed. The bracket 310 is a frame for fixing and supporting a plurality of electronic parts (e.g., a processor, a memory, a SIM card, an audio codec, a speaker, a receiver, a microphone, a camera module, an indicator, a motor, a power management module, a battery, a communication module, a user input module, a display module, an interface, and a sensor module). The bracket 310 may be shaped from a non-metal or a metal. The bracket 310 has a first surface in the upper part thereof, and a second surface in the lower part thereof. The first and second surfaces of the bracket 310 are mounting surfaces on which electronic parts are mounted. The first and/or second surfaces of the bracket 310 may include various surfaces such as a flat surface, a curved surface, and a slope surface. The window 411, the touch panel 412, and the display panel 413 may be placed on the bracket 310. The main circuit board 500 may be placed on the bracket 310. Electronic parts (e.g., a camera module) having a printed circuit board (PCB) may be placed on the bracket 310. Electronic parts (e.g., a sensor module, a user input module, a display module, and an interface), which are connected to the main circuit board 500 through an electrical connection member (e.g., a cable or a flexible printed circuit board (FPCB)), may be placed on the bracket 310. The bracket 310 may include a plurality of recesses in which a plurality of parts are placed. For example, the bracket 310 includes installation recesses 311 and 312 in an upper part 3101, and the window 411, the touch panel 412, the display panel 413, and a digitizer (not shown) are placed in the recesses 311 and 312. The bracket 310 includes an installation recess 315 in a lower part 3102, and the main circuit board 500 is placed in the installation recess 315. The bracket 310 includes an electronic part receiving recess 310-28 to receive electronic parts 502 protruding upward (e.g., toward the bracket 310) from the main circuit board 500. The bracket 310 includes battery receiving recesses 310-16 and 310-26 in the lower part 3102. The battery receiving recesses 310-16 and 310-26 receive a portion of the battery 416 and have a downwardly recessed container shape. The bracket 310 includes an upper bracket 310-1 and a lower bracket 310-2 fixed to a lower part of the upper bracket 310-1. The bracket 310 may include at least one metal part (not shown, e.g., a metal border or a metal coating part) which is electrically connected to a ground of the main circuit board 500.

The rear case 320 is coupled to the bracket 310 (e.g., through snap fit coupling or bolt coupling). According to an embodiment of the present invention, the rear case 320 is integrally formed with the battery cover 330. The rear case 320 covers a plurality of parts fixed to the bracket 310. The rear case 320 covers at least one portion of the main circuit board 500 fixed to the bracket 310. The bracket 310, the rear case 320, and the main circuit board 500 are coupled to one another according to a bolt coupling method. The rear case 320 includes an electronic part receiving recess 320-7 to receive electronic parts 503 protruding downward (e.g., toward the rear case 320) from the main circuit board 500. The rear case 320 includes a battery penetration part 320-6 through which the battery 416 passes. The battery penetration part 320-6 has an open shape passing through the upper and lower parts of the rear case 320 and communicates with the container-shaped battery receiving recesses 310-16 and 310-26 of the bracket 310. When the bracket 310 is coupled to the rear case 320, the battery receiving recesses 310-16 and 310-26 of the bracket 310, and the battery penetration part 320-6 of the rear case 320 may have a container-shaped space for receiving the battery 416 as a whole. The battery penetration part 320-6 of the rear case 320 may have a container shape for solely receiving the battery 416 as a whole, and the battery receiving recesses 310-16 and 310-26 of the bracket 310 may be unnecessary. Alternatively, the battery receiving recesses 310-16 and 310-26 may have a container shape for solely receiving the battery 416 as a whole, and the battery penetration part 320-6 of the rear case 320 may be unnecessary.

The battery cover 330 is coupled to the rear case 320 and forms a rear surface of the electronic apparatus 200. The battery cover 330 may include a plurality of hooks (not shown) on a border thereof, and the hooks may be coupled to a plurality of hook coupling recesses of the rear case 320.

The main circuit board 500 (e.g., a main board or a mother board) is a board on which a basic circuit and a plurality of electronic parts are mounted, and sets an execution environment of the electronic apparatus 200, and maintains information of the execution environment, stably drives the electronic apparatus 200, and facilitates data input/output/exchange of all devices of the electronic apparatus 200. The main circuit board 500 is coupled to the bracket 310 by using a bolt coupling method.

Figure 3:
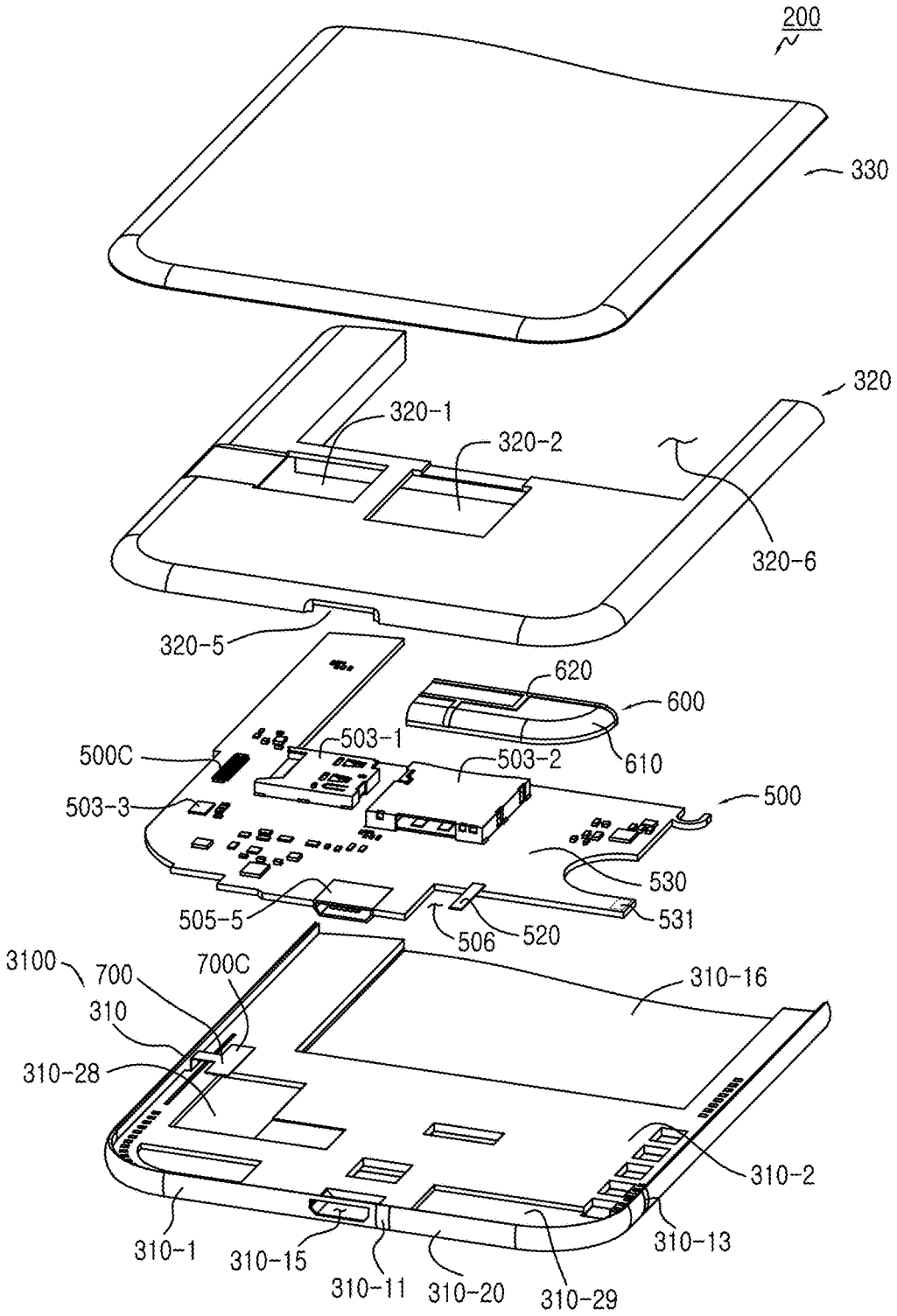
FIG. 3 illustrates an exploded perspective view of an electronic apparatus according to an embodiment of the present invention.

FIG. 3 illustrates an exploded perspective view of an electronic apparatus according to an embodiment of the present invention. Referring to FIG. 3, the electronic apparatus 200 includes a bracket module 3100, the rear case 320, the battery cover 330, a first antenna part 600, and the main circuit board 500.

Figure 4:
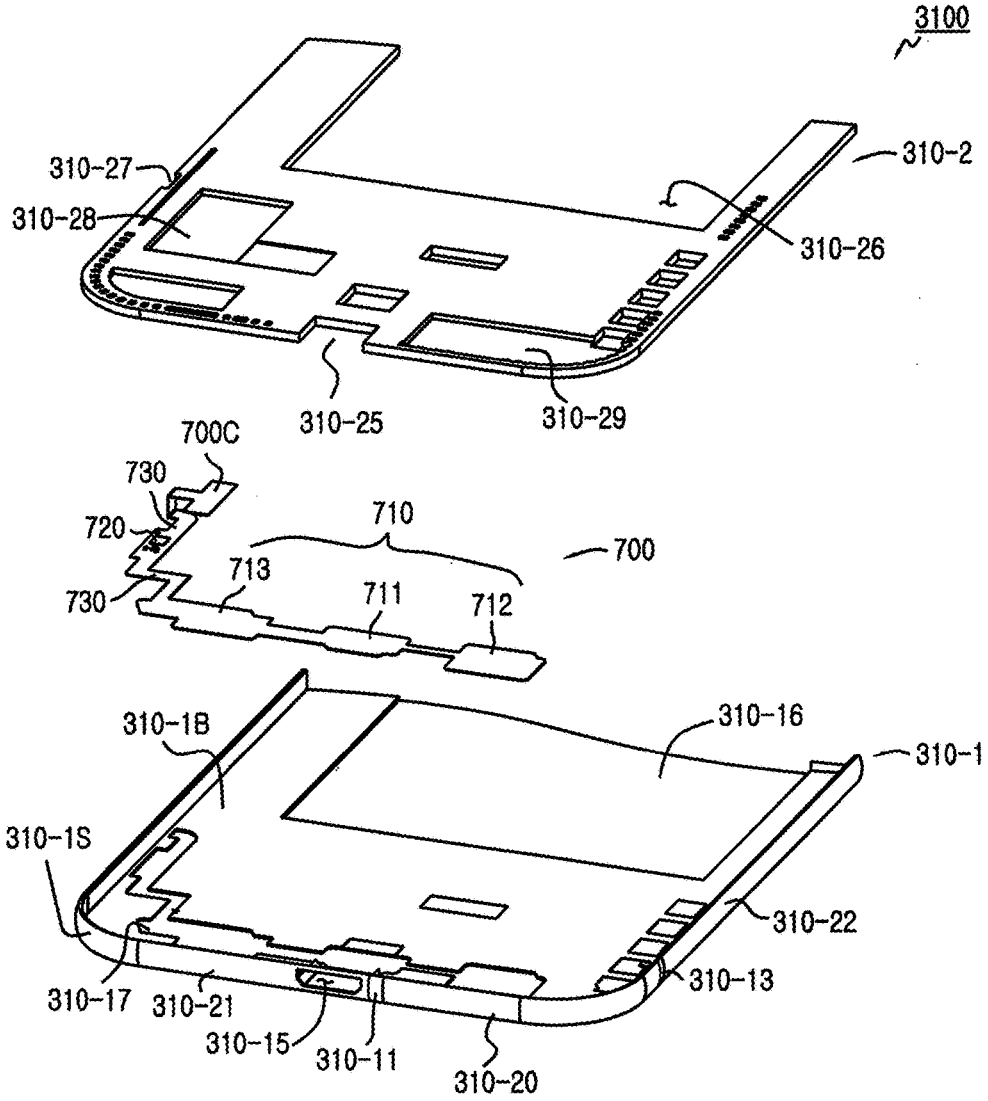
FIG. 4 illustrates an exploded perspective view of a bracket module according to various embodiments of the present invention.

The bracket module 3100 includes the bracket 310 and a key device 700. FIG. 4 illustrates an exploded perspective view of the bracket module 3100 according to an embodiment of the present invention. Referring to FIG. 4, the bracket 310 is a mounting plate (an installation plate) on which a plurality of electronic parts are installed. The bracket 310 is a frame for fixing and supporting a plurality of electronic parts. The bracket 310 includes the upper bracket 310-1 and the lower bracket 310-2.

The upper bracket 310-1 includes a bottom 310-1B and a side wall 310-1S surrounding the border of the bottom 310-1B and has a container shape. The upper bracket 310-1 includes the battery receiving recess 310-16 in the bottom 310-1B, and the battery receiving recess 310-16 receives a portion of the battery 416 (see FIG. 2). The lower bracket 310-2 is fixed to a lower part of the bottom 310-1B of the upper bracket 310-1. The window 411, the touch panel 412, and the display panel 413 are fixed to an upper part of the bottom 310-1B of the upper bracket 310-1.

The upper bracket 310-1 includes a penetration part 310-15 through which an external port 505-5 (see FIG. 3, e.g., an external port 206) of the main circuit board 500 is exposed to the outside. The upper bracket 310-1 includes an installation recess 310-17 in the bottom 310-1B, and the key device 700 is placed in the installation recess 310-17. The side wall 310-1S of the upper bracket 310-1 includes at least one metal part 310-20 formed of a metal. For example, the side wall 310-1S of the upper bracket 310-1 includes a non-conductive inner wall integrally protruding from the bottom 310-1B, and a metallic outer wall overlapping the non-conductive inner wall. The metallic outer wall of the side wall 310-1S forms a border of the electronic apparatus 200 and is divided into two or more metal parts 310-20, 310-21, and 310-22 that are electrically separated from one another. Spaces formed between the metal parts 310-20, 310-21, and 310-22 are filled with non-conductive members 310-11 and 310-13. The non-conductive members 310-11 and 310-13 extend from the inner wall of the side wall 310-1S. The at least one metal part 310-20 of the side wall 310-1S is electrically connected to a ground pad 531 (see FIG. 3) of the main circuit board 500. The at least one metal part 310-20 may be used as an antenna element (a second antenna part) that resonates by receiving an electric current from the main circuit board 500 according to an indirect feed method. For example, a first antenna radiator 620 (see FIG. 3) of the first antenna part 600 may be electromagnetically coupled to a resonance of the feed part 520, thereby flowing the electric current into the at least one metal part 310-20 electronically connected to the first antenna radiator. An end of the at least one metal part 310-20 is electrically connected to the ground pad 531 (see FIG. 3) of the main circuit board 500. Another end of the at least one metal part 310-20 may be electrically connected to the first antenna radiator 620 (see FIG. 3) of the first antenna part 600.

The lower bracket 310-2 is fixed to the bottom 310-1B of the upper bracket 310-1. The main circuit board 500 (see FIG. 3) is fixed to the lower bracket 310-2. The lower bracket 310-2 includes the electronic part receiving recess 310-28 to receive parts mounted on the main circuit board 500. The lower bracket 310-2 includes a carrier installation recess 310-29, and the first antenna part 600 (see FIG. 3) is placed in the carrier installation recess 310-29. The lower bracket 310-2 includes the battery receiving recess 310-26 (see FIG. 2) through which the battery 416 (see FIG. 2) passes. The battery receiving recess 310-26 of the lower bracket 310-2 communicates with the battery receiving recess 310-16 of the upper bracket 310-1. The lower bracket 310-2 includes a recess 310-25 through which the external port 505-5 (see FIG. 3) of the main circuit board 500 passes.

The key device 700 (a sub circuit board or a sub board) includes a key circuit part 710, a control circuit part 720, a FPCB 730, and a connector 700C. A plurality of key pads (e.g., a press key pad 711 and touch key pads 712 and 713) are mounted on the key circuit part 710. The key pads 711, 712, and 713 are electrically connected in series to one another. The control circuit part 720 detects a press or a touch of the key pads 711, 712, and 713 of the key circuit part 710. The FPCB 730 extends from the key circuit part 710, and the connector 700C and the control circuit part 720 are mounted on the FPCB 730. The key device 700 is constituted by an FPCB. The key circuit part 710 of the key device 700 is disposed between the upper bracket 310-1 and the lower bracket 310-2. The key circuit part 710 of the key device 700 is disposed between the lower bracket 310-2 and the window 411 (see FIG. 2). The connector 700C of the key device 700 is passed through a recess 310-27 of the lower bracket 310-2 and be then electrically connected to the connector 500C (see FIG. 3) of the main circuit board 500 fixed to the lower bracket 310-2. The key device 700 includes at least one radiation pattern. The at least one radiation pattern of the key device 700 is electrically connected to a ground part 530 (see FIG. 3) of the main circuit board 500 through the connector 700C. The at least one radiation pattern of the key device 700 is directly connected to the ground part 530 of the main circuit board 500 through an electrical connection member (not shown). The at least one radiation pattern of the key device 700 is separately mounted or includes at least one signal line related to a key operation, as a common part. The at least one radiation pattern of the key device 700 is an antenna element (a third antenna part) that resonates by receiving an electric current from the main circuit board 500 according to an indirect feed method. The electric current fed from the main circuit board 500 according to the indirect feed method is circulated along the radiation pattern of the key device 700 and is introduced into the ground part 530 (see FIG. 3) of the main circuit board 500. Accordingly, transmission line is formed to transmit and receive radio electromagnetic waves.

Referring back to FIG. 3, the rear case 320 is coupled to the bracket 310. The rear case 320 includes the battery penetration part 320-6 through which the battery 416 (see FIG. 2) passes. The rear case 320 includes penetration parts 320-1 and 320-2 through which sockets of the main circuit board 500 (e.g., memory card sockets 503-1 and 503-2) pass. The rear case 320 includes an external port penetration part 320-5 through which an external port 505-5 of the main circuit board 500 passes. The rear case 320 may include at least one metal part (not shown) that may be electrically connected to the first antenna radiator 620 of the first antenna part 600. The rear case 320 may include at least one metal part (not shown) that may be electrically connected to the ground part 530 of the main circuit board 500.

The battery cover 330 is coupled to the rear case 320 and forms a surface (e.g., the rear surface) of the electronic apparatus 200. The battery cover 330 includes at least one metal part (not shown) that may be electrically connected to the first antenna radiator 620 of the first antenna part 600. The battery cover 330 includes at least one metal part (not shown) that may be electrically connected to the ground part 530 of the main circuit board 500.

The first antenna part 600 includes a carrier 610 and the first antenna radiator 620. The carrier 610 is shaped from a plastic resin (e.g., a polyethylene resin, an acrylonitrile butadiene styrene (ABS) resin, a polyvinyl chloride (PVC) resin, or a polycarbonate resin). The carrier 610 is fixed to the lower bracket 310-2 of the bracket 310. The first antenna radiator 620 is attached to the carrier 610. For example, the first antenna radiator 620 is shaped on a surface of the carrier 610 according to a printing method. The first antenna radiator 620 resonates by receiving an electric current from the main circuit board 500 according to an indirect feed method. The first antenna radiator 620 is electrically connected to the at least one metal part 310-20 of the upper bracket 310-1 through an electrical connection member (e.g., a conductive tape, a C-clip, a pogo-pin, or solder). An electric current indirectly fed from the main circuit board 500 is circulated along a radiation pattern formed by the first antenna radiator 620 and the at least one metal part 310-20 and is introduced into the ground part 530 through the ground pad 531 connecting the at least one metal part 310-20 and the main circuit board 500 to each other. Accordingly, a transmission line is formed to transmit and receive radio electromagnetic waves.

The main circuit board 500 is fixed to the lower bracket 310-2 and is disposed between the lower bracket 310-2 and the rear case 320. A plurality of parts (e.g., the connector 500C, the sockets 503-1 and 503-2, a chip 503-3, and the external port 500-5) is mounted on the main circuit board 500. The main circuit board 500 processes a signal received and transmitted through at least one antenna radiator. The main circuit board 500 includes a carrier penetration part 506 through which the carrier 610 of the first antenna part 600 fixed to the bracket 310 passes. The main circuit board 500 includes a feed part 520 and the ground part 530. The feed part 520 is divided to be disposed on the first antenna radiator 620 of the first antenna part 600, the at least one metal part 310-20 of the bracket 310, and the at least one radiation pattern of the key device 700 (see FIG. 4). At least one portion of the first antenna radiator 620 is disposed to indirectly receive an electric current from the feed part 520. For example, at least one portion of the first antenna radiator 620 is spaced apart from the feed part 520 by 0.1 mm to 0.5 mm. At least one portion of the at least one radiation pattern of the key device 700 (see FIG. 4) is disposed to indirectly receive an electric current from the feed part 520. For example, at least one portion of the at least one radiation pattern of the key device 700 is spaced apart from the feed part 520 by 0.1 mm to 0.5 mm. At least one portion of the feed part 520 is disposed between the first antenna radiator 620 of the first antenna part 600 and the at least one metal part (not shown) of the key device 700. The feed part 520 is disposed in a feed part receiving recess 611 (see FIG. 5) formed in the carrier 610 of the first antenna part 600. The ground part 530 is used for grounding and is electrically connected to the ground pad 531. The ground part 530 is horizontally or vertically disposed on a surface of the main circuit board 500. The ground part 530 has a flat plate structure with grooves or holes having various shapes.

Figure 5:
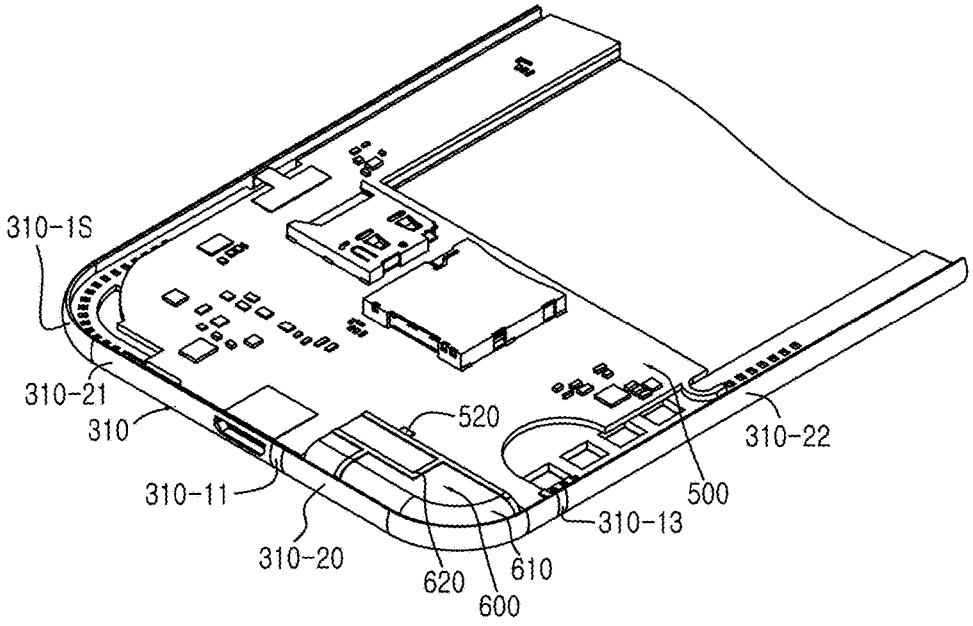
FIG. 5 illustrates a perspective view of an electronic apparatus with a battery cover and a rear case being detached, according to an embodiment of the present invention.
Figure 5:
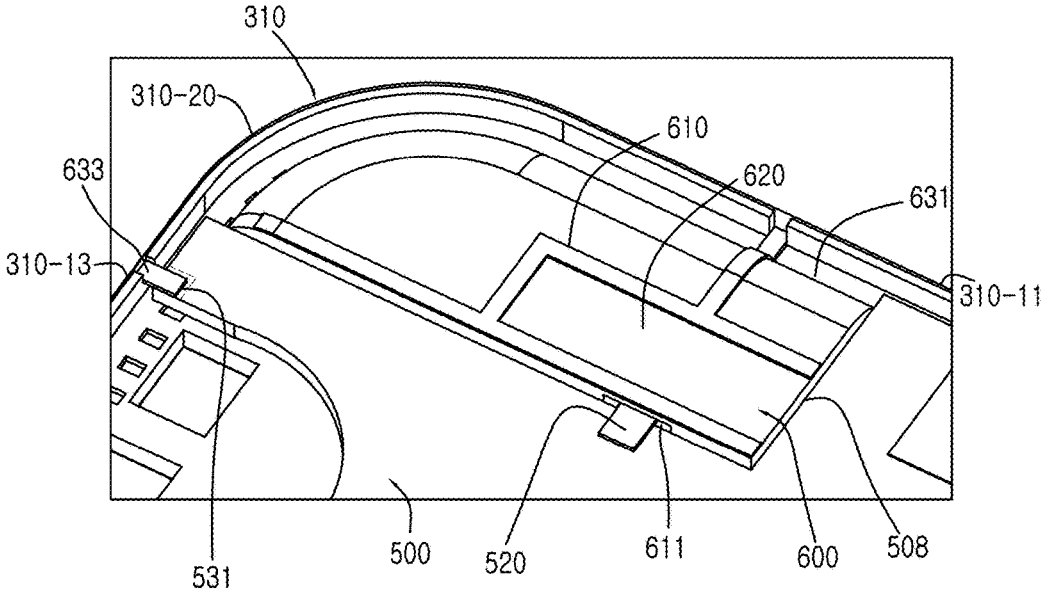

FIG. 5 illustrates a perspective view of an electronic apparatus with a battery cover and a rear case being detached, according to an embodiment of the present invention.

Referring to FIG. 5, the side wall 310-1S of the bracket 310 includes a metal border exposed to the outside. The metal border includes the metal part 310-20 that is electrically separated from the metal parts 310-21 and 310-22 by two discontinuity parts 310-11 and 310-13. The metal part 310-20 is electrically connected to the ground pad 531 of the main circuit board 500 through at least one electrical connection member 633 (e.g., a conductive tape, a C-clip, a pogo-pin, or solder). The ground pad 531 is provided in plurality to be in a plurality of locations, and a plurality of connecting parts are formed between the metal part 310-20 and the ground pads 531. The metal part 310-20 is electrically connected to at least one portion of the first antenna radiator 620 of the first antenna part 600 through at least one electrical connection member 631 (e.g., a conductive tape, a C-clip, a pogo-pin, or solder).

The first antenna radiator 620 is electrically connected to the ground pad 531 of the main circuit board 500 through the metal part 310-20. The first antenna part 600 does not overlap the main circuit board 500. For example, the first antenna part 600 is passed through a carrier penetration part 508 provided on the main circuit board 500 and is then fixed to the bracket 310. The carrier 610 of the first antenna part 600 includes the feed part receiving recess 611 having a opening, and the feed part 520 of the main circuit board 500 is inserted in the feed part receiving recess 611 of the carrier 610. The feed part 520 of the main circuit board 500 is separated from the first antenna radiator 620, but overlaps at least one portion of the first antenna radiator 620. The first antenna radiator 620 indirectly receives an electric current from the feed part 520 of the main circuit board 500, and the radiation pattern formed by the first antenna radiator 620 and the metal part 310-20 transmit and receive radio electromagnetic waves. Although not shown, the at least one radiation pattern included in the key device 700 fixed to the bracket 310 also indirectly receives an electric current from the feed part 520 of the main circuit board 500 and transmits and receives radio electromagnetic waves.

Figure 6:
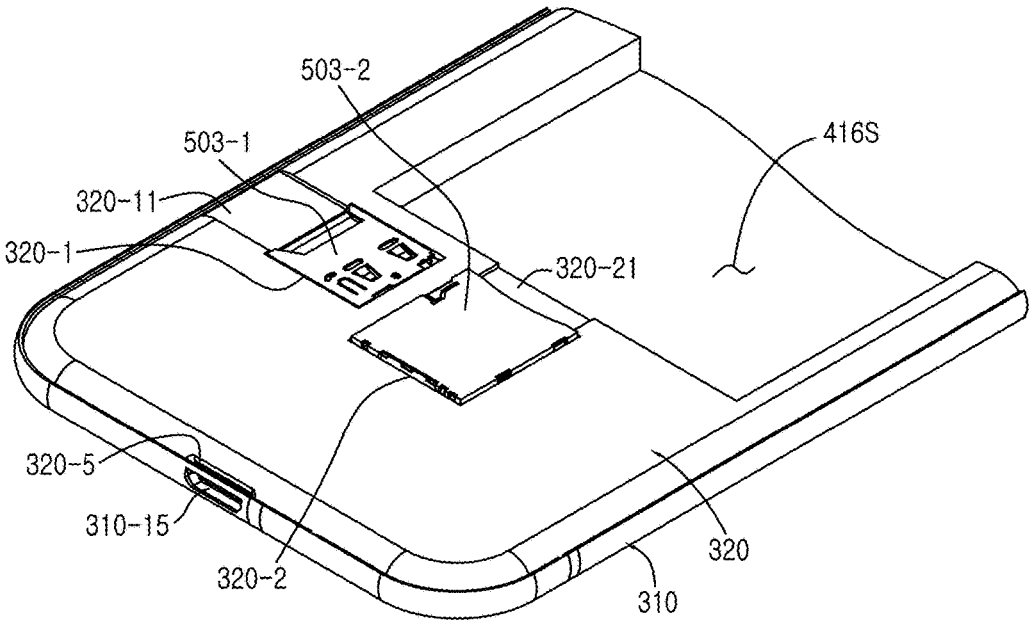
FIG. 6 illustrates a perspective view of an electronic apparatus with a battery cover detached, according to an embodiment of the present invention.

FIG. 6 illustrates a perspective view of an electronic apparatus with a battery cover detached, according to an embodiment of the present invention.

Referring to FIG. 6, the sockets 503-1 and 503-2 of the main circuit board 500 are passed through the penetration parts 320-1 and 320-2 of the rear case 320 and are then exposed. The rear case 320 includes recesses 320-11 and 320-21 to guide installation and removal of memories in and out of the sockets 503-1 and 503-2. The external port 505-5 (see FIG. 3) of the main circuit board 500 is passed through the external port penetration part 320-5 of the rear case 320 and is then exposed through the penetration part 310-15 of the bracket 310. A battery receiving space 416S is formed by coupling the bracket 310 and the rear case 320 to each other.

Figure 7:
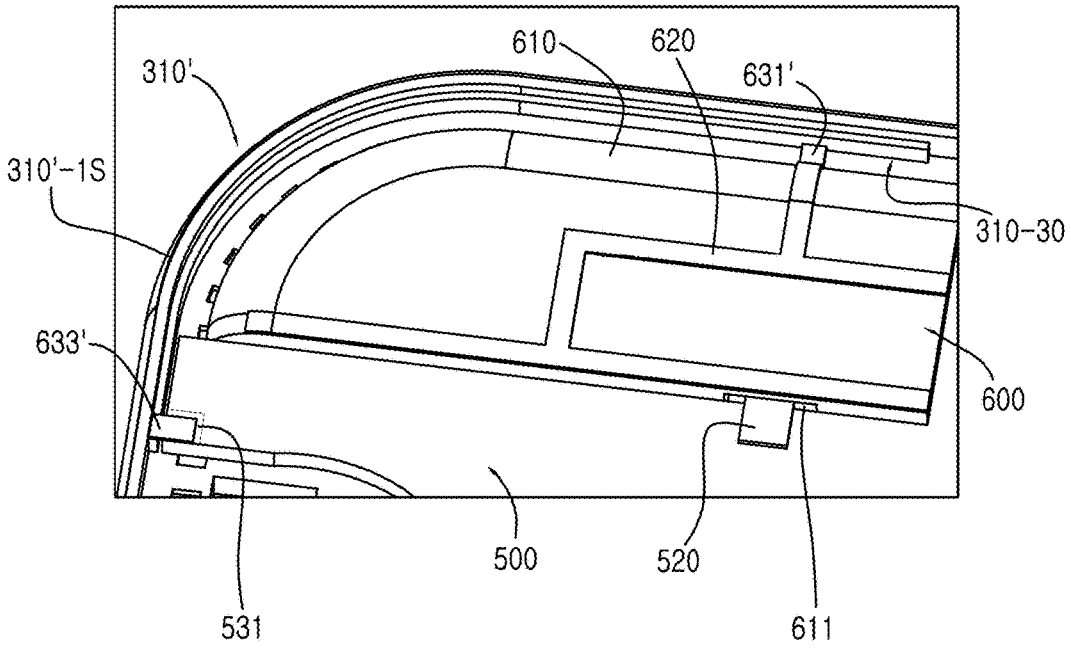
FIG. 7 illustrates a perspective view of an electronic apparatus with a battery cover and a rear case being detached, according to an embodiment of the present invention.

FIG. 7 illustrates a perspective view of an electronic apparatus with a battery cover and a rear case being detached, according to an embodiment of the present invention.

Referring to FIG. 7, a bracket 310' according to an embodiment of the present invention is a non-conductive injection-molded part, and a conductive metal member 310-30 is attached to an inner part of a side wall 310'-1S. The conductive metal member 310-30 has a strip shape with a predetermined length and is formed along an inner surface of the bracket 310'. An end of the conductive metal member 310-30 is electrically connected to the ground pad 531 of the main circuit board 500 through an electrical connection member 633' (e.g., a conductive tape, a C-clip, a pogo-pin, or solder). The other end of the conductive metal member 310-30 is electrically connected to the first antenna radiator 620 of the first antenna part 600 through an electrical connection member 631' (e.g., a conductive tape, a C-clip, a pogo-pin, or solder). The first antenna radiator 620 is electrically connected to the ground pad 531 of the main circuit board 500 through the metal member 310-30. The first antenna part 600 is passed through the carrier penetration part 508 (see FIG. 3) provided on the main circuit board 500 and is then fixed to the bracket 310. The carrier 610 of the first antenna part 600 includes the feed part receiving recess 611 that is open downward, and the feed part 520 of the main circuit board 500 is inserted in the feed part receiving recess 611 of the carrier 610. The first antenna radiator 620 indirectly receives an electric current from the feed part 520 of the main circuit board 500, and a radiation pattern formed by the first antenna radiator 620 and the metal member 310-30 transmit and receive radio electromagnetic waves.

Figure 8:
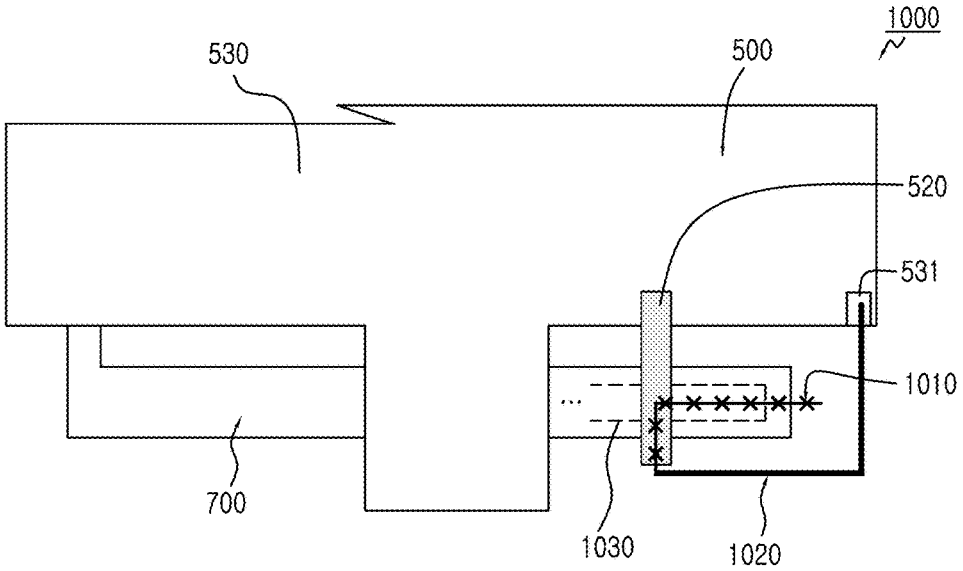
FIG. 8 illustrates a schematic view of an antenna device according to an embodiment of the present invention.

FIG. 8 illustrates a schematic view of an antenna device according to an embodiment of the present invention. Referring to FIG. 8, an antenna device 1000 includes the main circuit board 500, a first antenna radiator 1010, a second antenna radiator 1020, and a third antenna radiator 1030.

The main circuit board 500 includes the feed part 520 and the ground pad 531. An electric current (a signal) may be applied to the feed part 520. The feed part 520 resonates using the electric current. The ground pad 531 (e.g., a copper foil pad or a land) is electrically connected to a ground part 530 formed on the main circuit board 500.

The first antenna radiator 1010 (e.g., the first antenna radiator 620) is separated from the feed part 520, and indirectly receives an electric current from the feed part 520. For example, the first antenna radiator 1010 may be electromagnetically coupled to a resonance of the feed part 520. The first antenna radiator 1010 may be attached to a non-conductive injection-molded part (e.g., the carrier 610 of FIG. 3). The first antenna radiator 1010 may be disposed on the main circuit board 500. The first antenna radiator 1010 may be disposed on a case (e.g., the bracket 310, the rear case 320, or the battery cover 330 of FIG. 3) that defines an outer surface, or simply appearance of the electronic apparatus 200.

An end of the second antenna radiator 1020 is electrically connected to the first antenna radiator 1010. The other end of the second antenna radiator 1020 is electrically connected to the ground pad 531 of the main circuit board 500. The second antenna radiator 1020 is at least one metal member (e.g., the metal part 310-20 of FIG. 4 or the metal member 310-30 of FIG. 7) included in a structure of the electronic apparatus 200 (e.g., the bracket 310, the rear case 320, or the battery cover 330 of FIG. 3).

An electric current indirectly fed to the first antenna radiator 1010 from the feed part 520 is circulated along a radiation pattern formed by the first antenna radiator 1010 and the second antenna radiator 1020 and is introduced into the ground part 530 of the main circuit board 500. Accordingly, a transmission line is formed to transmit and receive radio electromagnetic waves.

The third antenna radiator 1030 may be the at least one radiation pattern included in the key device 700. The key device 700 is formed as a single piece and is electrically connected to the main circuit board 500 through an electrical connection member (e.g., a connector). The third antenna radiator 1030 is electrically connected to the ground part 530 of the main circuit board 500. The third antenna radiator 1030 is spaced apart from the feed part 520. The third antenna radiator 1030 is spaced apart from the first antenna radiator 1010 and the second antenna radiator 1020. The third antenna radiator 1030 indirectly receives an electric current from the feed part 520. For example, the third antenna radiator 1030 is electromagnetically coupled to a resonance of the feed part 520. An electric current indirectly fed to the third antenna radiator 1030 from the feed part 520 is circulated along a radiation pattern of the third antenna radiator 1030 and is introduced into the ground part 530 of the main circuit board 500. Accordingly, a transmission line is formed to transmit and receive radio electromagnetic waves.

The first antenna radiator 1010 and the second antenna radiator 1020 are different from the third antenna radiator 1030, in terms of radiation pattern length. Thus, a frequency band of a signal transmitted and received by a resonance of the first antenna radiator 1010 and the second antenna radiator 1020 is different from that of a signal transmitted and received by a resonance of the third antenna radiator 1030. For example, the first antenna radiator 1010 and the second antenna radiator 1020 is used to transmit and receive a signal of a low frequency band (e.g., 700 MHz to 960 MHz), and the third antenna radiator 1030 is used to transmit and receive a signal of a high frequency band (e.g., 2.5 GHz to 2.7 GHz).

Figure 9:
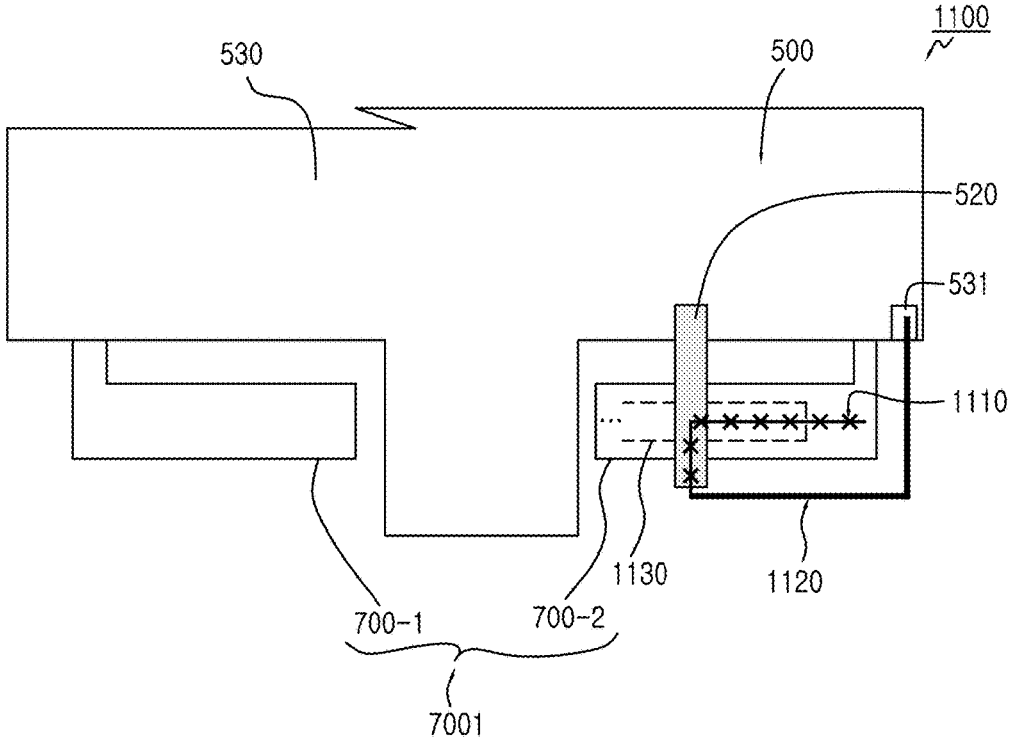
FIG. 9 illustrates a schematic view of an antenna device according to an embodiment of the present invention.

FIG. 9 illustrates a schematic view of an antenna device according to an embodiment of the present invention. Referring to FIG. 9, an antenna device 1100 includes the main circuit board 500, a first antenna radiator 1110, a second antenna radiator 1120, and a third antenna radiator 1130.

The main circuit board 500 includes the feed part 520 and the ground pad 531.

The first antenna radiator 1110 (e.g., the first antenna radiator 620 of FIG. 3) is separated from the feed part 520, and indirectly receives an electric current from the feed part 520.

An end of the second antenna radiator 1120 is electrically connected to the first antenna radiator 1110. The other end of the second antenna radiator 1120 is electrically connected to the ground pad 531 of the main circuit board 500. The second antenna radiator 1120 is at least one metal member (e.g., the metal part 310-20 of FIG. 4 or the metal member 310-30 of FIG. 7) included in a structure of the electronic apparatus 200 (e.g., the bracket 310, the rear case 320, or the battery cover 330 of FIG. 3).

An electric current indirectly fed to the first antenna radiator 1110 from the feed part 520 is circulated along a radiation pattern formed by the first antenna radiator 1110 and the second antenna radiator 1120 and is introduced into the ground part 530 of the main circuit board 500. Accordingly, a transmission line is formed to transmit and receive radio electromagnetic waves.

The third antenna radiator 1130 is at least one radiation pattern included in a key device 7001. The key device 7001 is divided into a plurality of parts 700-1 and 700-2. The parts 700-1 and 700-2 are electrically connected to the main circuit board 500. The part 700-2, as at least one portion of the key device 7001, overlaps the feed part 520 and includes a radiation pattern electrically connected to the ground part 530. The third antenna radiator 1130 is spaced apart from the feed part 520. The third antenna radiator 1130 indirectly receives an electric current from the feed part 520. An electric current indirectly fed to the third antenna radiator 1130 from the feed part 520 is circulated along a radiation pattern of the third antenna radiator 1130 and is introduced into the ground part 530 of the main circuit board 500. Accordingly, a transmission line is formed to transmit and receive radio electromagnetic waves.

Figure 10:
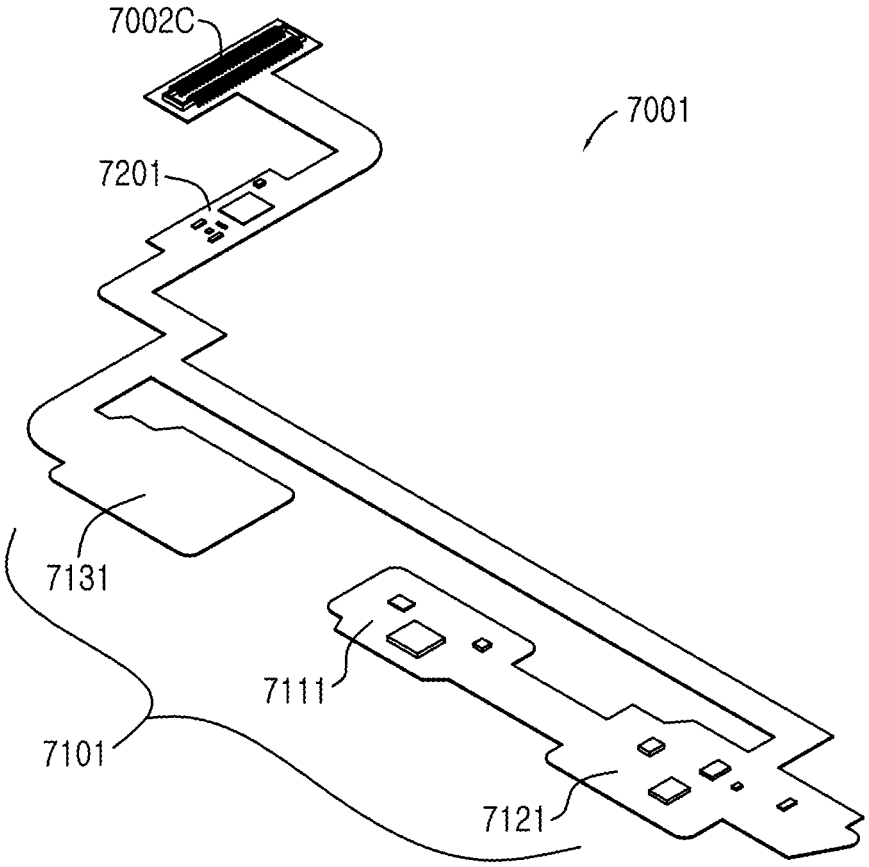
FIG. 10 illustrates a perspective view of a key device according to an embodiment of the present invention.

FIG. 10 illustrates a perspective view of a key device according to an embodiment of the present invention.

Figure 11A:
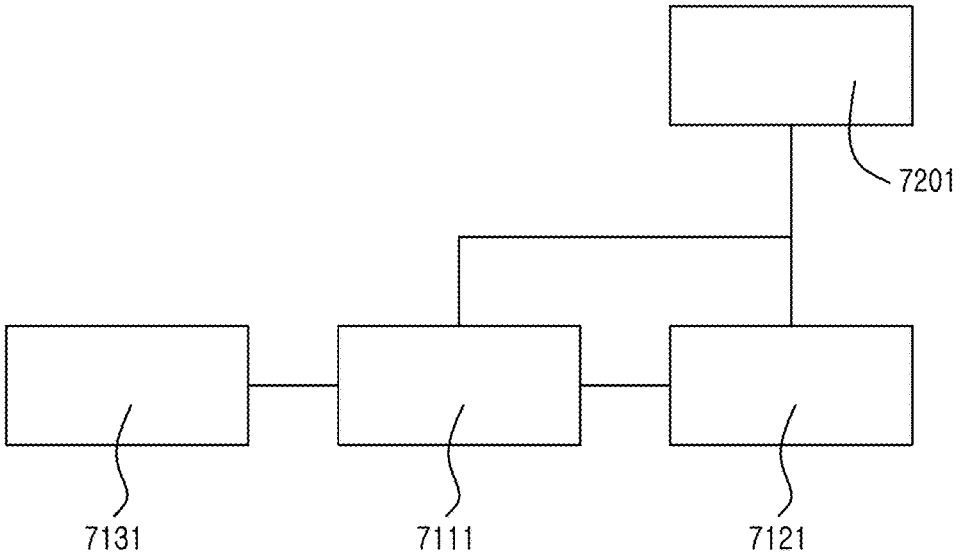
FIGS. 11A and 11B illustrate views of various electrical connection structures of key devices according to an embodiment of the present invention.
Figure 11B:
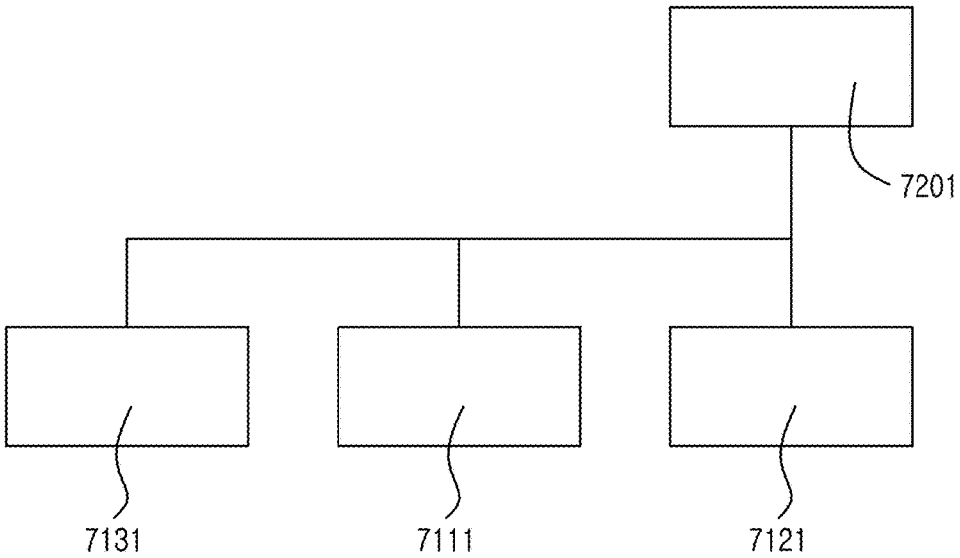

Referring to FIG. 10, the key device 7001 includes a key circuit part 7101, a control circuit part 7201, and a connector 7002C, which are electrically connected to one another. A plurality of key pads (e.g., a press key pad 7111 and touch key pads 7121 and 7131) are mounted on the key circuit part 7101. The control circuit part 7201 detects a press or a touch of the key pads 7111, 7121, and 7131 of the key circuit part 7101. An electrical connection structure between the key pads 7111, 7121, and 7131 of the key circuit part 7101 is variously changed to ensure an antenna performance by using a radiation pattern of the key device 7001. For example, the key pads 7111, 7121, and 7131 of the key circuit part 7101 are disposed in an electrical connection structure branched from the control circuit part 7201. For example, FIGS. 11A and 11B illustrate views of various electrical connection structures of key devices according to an embodiment of the present invention.

FIGS. 12A to 12D are schematic views illustrating antenna devices according to an embodiment of the present invention. An antenna device 1200 includes a front case 1210, a rear case 1220, a carrier 1310, a first antenna radiator 1320, a second antenna radiator 1330, and the main circuit board 500. The front case 1210 (e.g., the bracket 310 of FIG. 3) is disposed at the front side of the electronic apparatus 200. The rear case 1220 (e.g., the rear case 320 or the battery cover 330 of FIG. 3) is disposed at the rear side of the electronic apparatus 200 and is coupled to the front case 1210. The carrier 1310 is shaped from a non-conductive material and is fixed to an inner part of the front case 1210. The first antenna radiator 1320 is attached to the carrier 1310. The main circuit board 500 is disposed in a space formed by coupling the front case 1210 and the rear case 1220 and is fixed to the front case 1210. The main circuit board 500 is separated from the first antenna radiator 1320, but includes the feed part 520 that overlaps at least one portion of the first antenna radiator 1320. The feed part 520 indirectly feeds an electric current to the first antenna radiator 1320. The second antenna radiator 1330 is electrically connected to the first antenna radiator 1320 and the ground part 530 of the main circuit board 500. An electric current indirectly fed to the first antenna radiator 1320 from the feed part 520 is circulated along a radiation pattern formed by the first antenna radiator 1320 and the second antenna radiator 1330 and is introduced into the ground part 530 of the main circuit board 500. Accordingly, a transmission line is formed to transmit and receive radio electromagnetic waves.

Figure 12A:
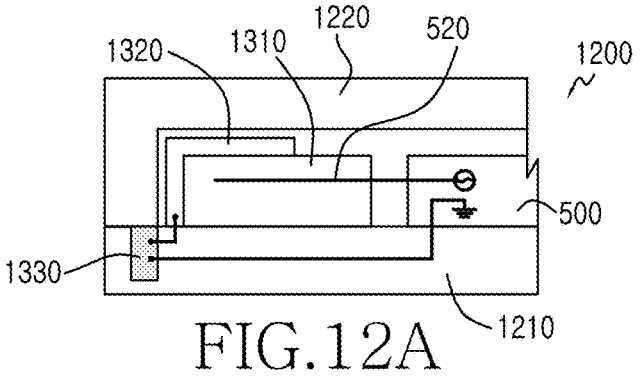
FIGS. 12A to 12D illustrate schematic views of antenna devices according to an embodiment of the present invention.

Referring to FIG. 12A, the second antenna radiator 1330 may be disposed inside of the front case 1210.

Figure 12B:
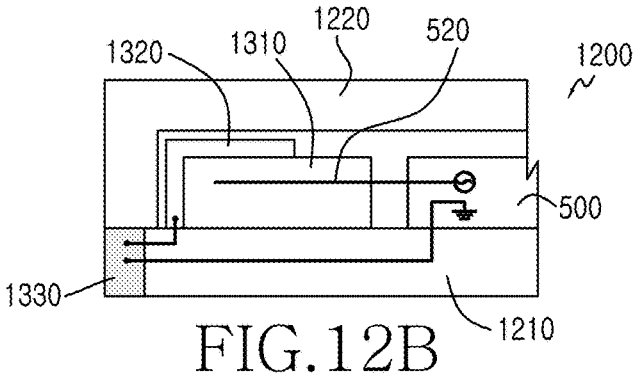

Referring to FIG. 12B, the second antenna radiator 1330 may be disposed outside of the front case 1210.

Figure 12C:
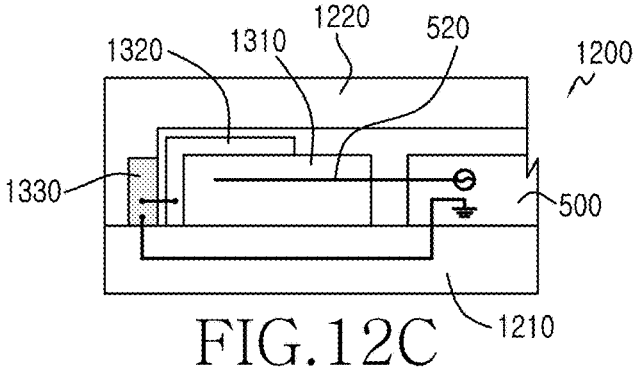

Referring to FIG. 12C, the second antenna radiator 1330 may be disposed inside of the rear case 1220.

Figure 12D:
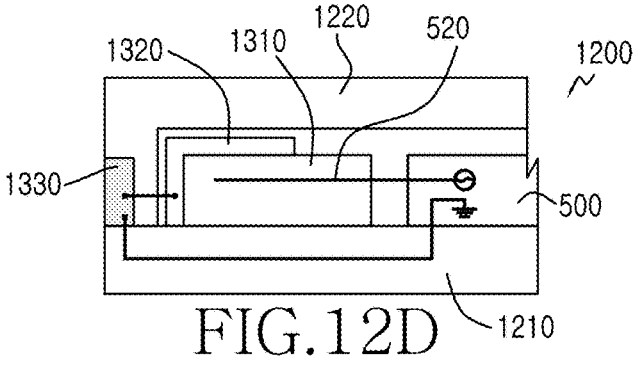

Referring to FIG. 12D, the second antenna radiator 1330 may be disposed outside of the rear case 1220.

Figure 13:
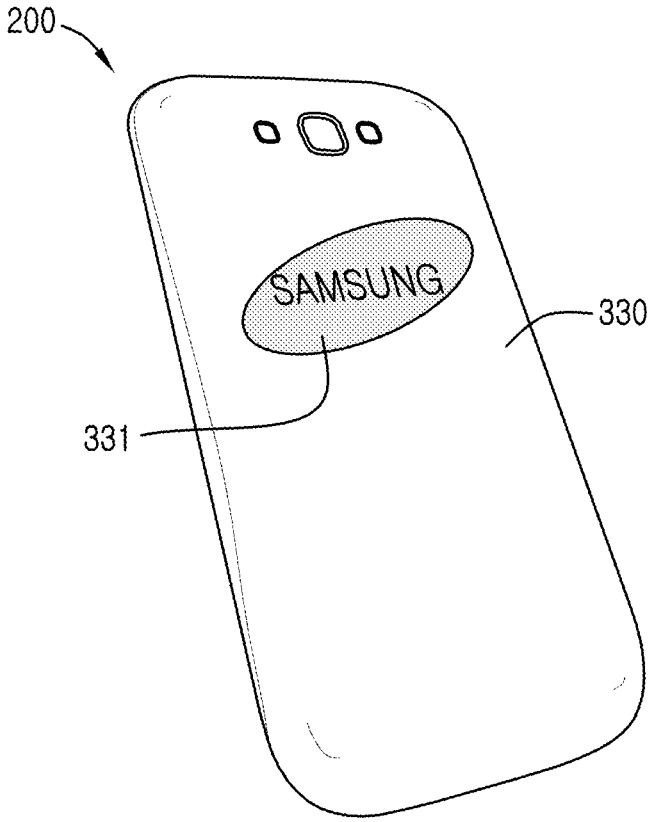
FIG. 13 illustrates a perspective view of the rear of an electronic apparatus according to an embodiment of the present invention.

FIG. 13 illustrates a perspective view of the rear of an electronic apparatus according to an embodiment of the present invention.

Referring to FIG. 13, the battery cover 330 of the electronic apparatus 200 includes a logo 331 formed of a metal on the outer surface thereof. The metallic logo 331 of the battery cover 330 is provided as the second antenna radiator 1330 of the antenna device 1200.

Figure 14A:
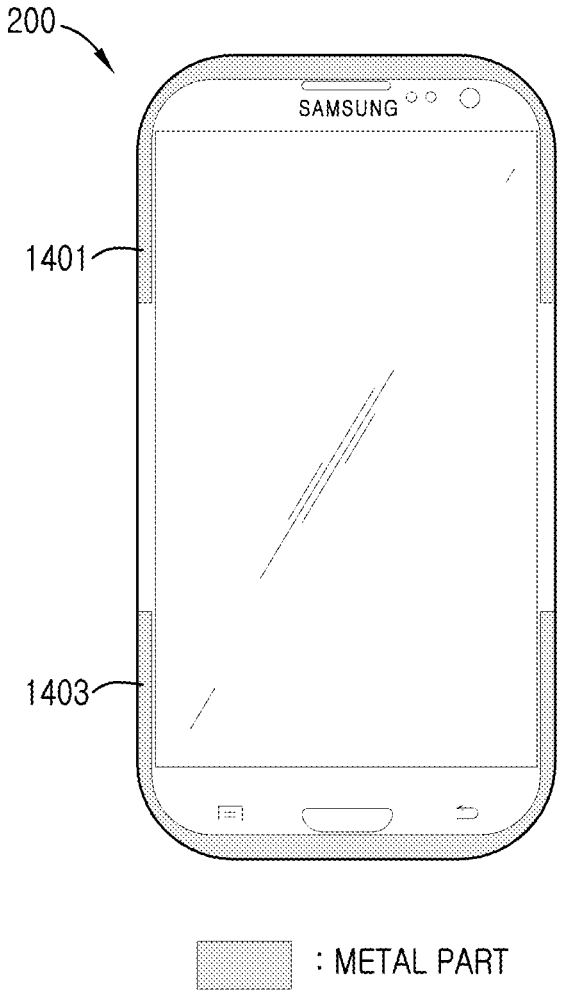
FIGS. 14A to 14C illustrate views of electronic apparatuses according to an embodiment of the present invention.
Figure 14B:
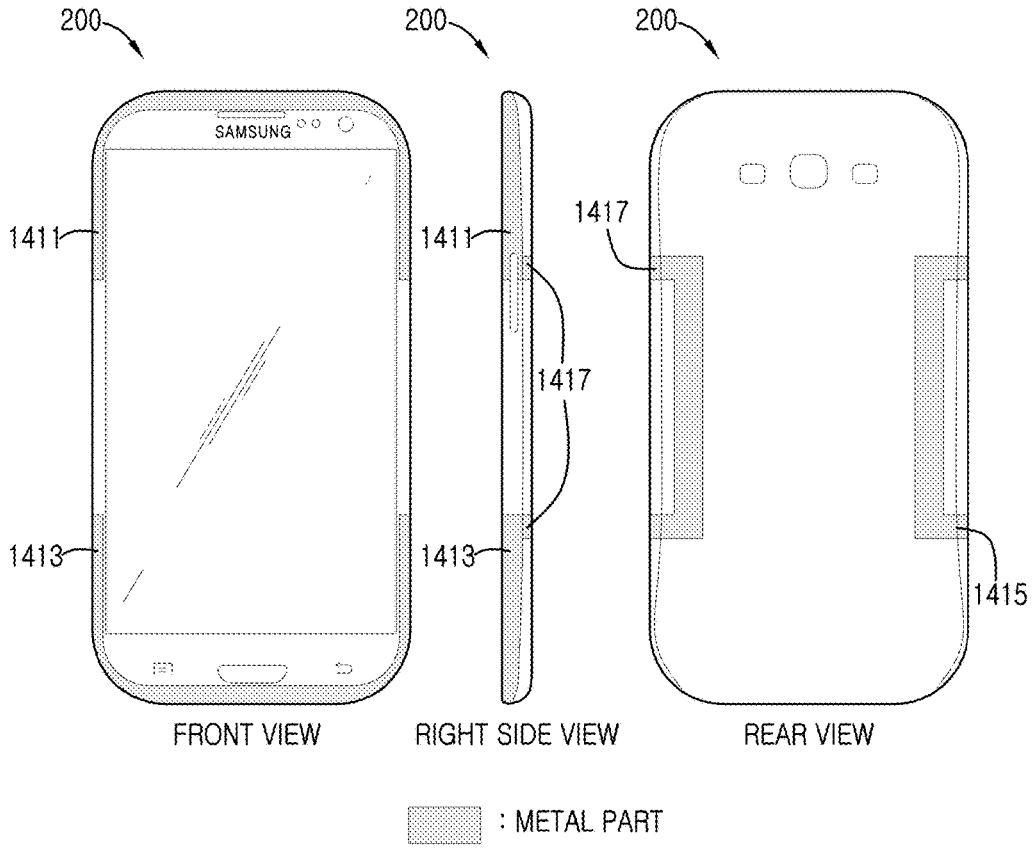
Figure 14C:
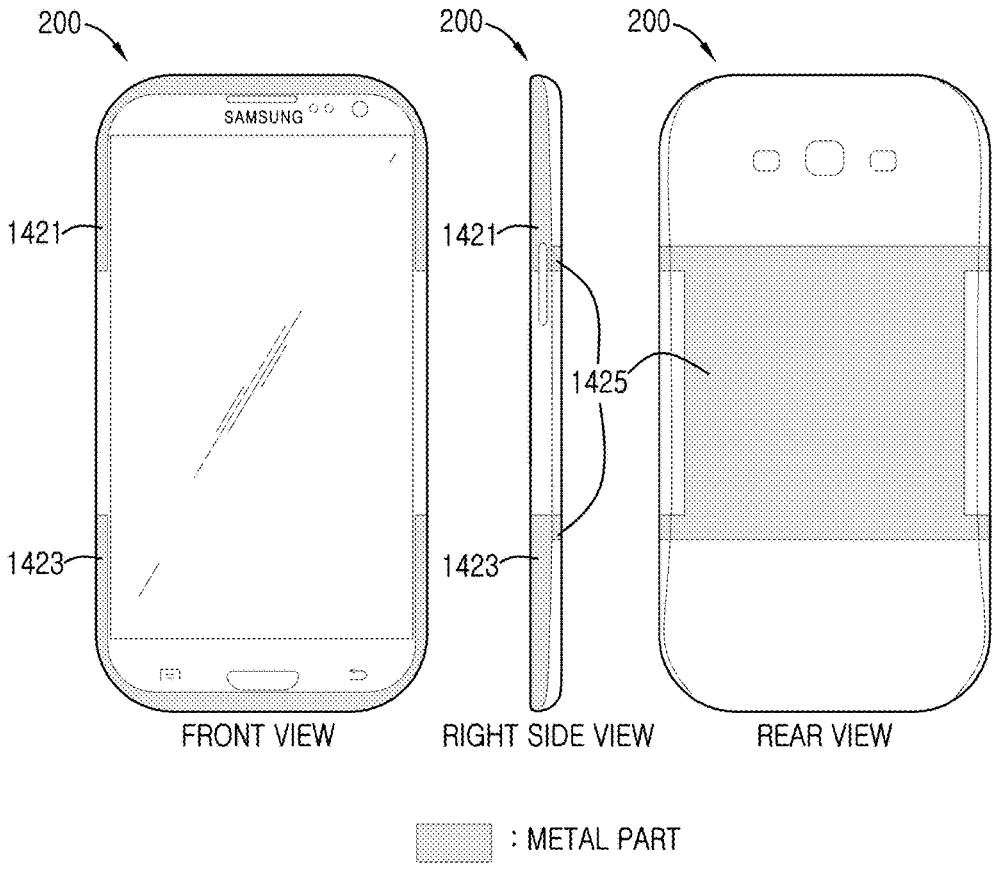

FIGS. 14A to 14C illustrate views of electronic apparatuses according to an embodiment of the present invention. The electronic apparatus 200 includes a case (e.g., the bracket 310, the rear case 320, or the battery cover 330 of FIG. 3) which forms an appearance thereof. The case of the electronic apparatus 200 includes one or more metal parts. The metal parts are disposed on an outer or inner surface of the case. The metal parts are attached to the case through insert injection molding. The metal parts are a conductive tape, a conductive spray, or a conductive plate. The metal part (e.g., the second antenna radiator 1330 of FIGS. 12A-12D) is electrically connected to the ground part 530 (see FIG. 3) of the main circuit board 500. The metal part (e.g., the second antenna radiator 1330 of FIGS. 12A-12D) indirectly receives an electric current from the main circuit board 500 to transmit and receive radio electromagnetic waves. For example, the metal part is electrically connected to the first antenna radiator 1320 (see FIGS. 12A-12D) that indirectly receives an electric current from the feed part 520 (see FIG. 3) of the main circuit board 500, and increases the length of a radiation pattern of the first antenna radiator 1320 (see FIGS. 12A-12D).

Referring to FIG. 14A, one or more metal parts 1401 and 1403 are disposed in a 'U' shape on the upper and lower parts of the case (e.g., the bracket 310 of FIG. 3), respectively.

Referring to FIG. 14B, one or more metal parts 1411 and 1413 are disposed in an 'U' shape on the upper and lower parts of a front case (e.g., the bracket 310 of FIG. 3), respectively. At least one metal part 1417 is disposed on a rear case (e.g., the battery cover 330 of FIG. 3) and electrically connects the right end parts of the U-shaped metal parts 1411 and 1413 disposed, respectively, on the upper and lower parts of the front case (e.g., the bracket 310 of FIG. 3), to each other. At least one metal part 1415 is disposed on the rear case (e.g., the battery cover 330 of FIG. 3) and electrically connects the left end parts of the U-shaped metal parts 1411 and 1413 disposed, respectively, on the upper and lower parts of the front case (e.g., the bracket 310 of FIG. 3), to each other. The metal parts 1411, 1413, 1415, and 1417 form a closed-loop.

Referring to FIG. 14C, one or more metal parts 1421 and 1423 are disposed in an 'U' shape on the upper and lower parts of a front case (e.g., the bracket 310 of FIG. 3), respectively. At least one metal part 1425 is disposed on a rear case (e.g., the battery cover 330 of FIG. 3) and electrically connects the left and right end parts of the U-shaped metal parts 1421 and 1423 disposed, respectively, on the upper and lower parts of the front case (e.g., the bracket 310 of FIG. 3), to each other. The metal parts 1421, 1423, and 1425 include slots in the upper and lower parts thereof.

In accordance with an embodiment of the present invention, an electronic apparatus 200 includes at least one first antenna radiator 620; a main board 500 including a feed part 520 that may be spaced apart from at least one portion of the at least one first antenna radiator 620 to overlap the at least one portion of the at least one first antenna radiator 620 and feeds an electric current to the at least one first antenna radiator according to an indirect feed method; at least one second antenna radiator 310-20 disposed on a housing 310 forming an appearance of the electronic apparatus 200; at least one first connection member 310-11 for electrically connecting the at least one first antenna radiator 620 to the at least one second antenna radiator 310-20; and at least one second connection member 310-13 for electrically connecting a ground part 530 formed on the main board 500 to the at least one second antenna radiator 310-20.

In accordance with an embodiment of the present invention, the electronic apparatus may further include at least one third antenna radiator 700 which has at least one portion spaced apart from the feed part 520 to overlap the feed part 520 and receives an electric current from the feed part 520 according to an indirect feed method and is electrically connected to the ground part 530 of the main board 500, wherein the feed part 520 may be disposed between the at least one first antenna radiator 620 and the at least one third antenna radiator 700.

In accordance with an embodiment of the present invention, a frequency band of a signal transmitted and received by a resonance of the at least one first antenna radiator 620 and the at least one second antenna radiator 310-20 may be different from that of a signal transmitted and received by a resonance of the at least one third antenna radiator 700.

In accordance with an embodiment of the present invention, a frequency band of a signal transmitted and received by a resonance of the at least one first antenna radiator 620 and the at least one second antenna radiator 310-20 may be lower than that of a signal transmitted and received by a resonance of the at least one third antenna radiator 700.

In accordance with an embodiment of the present invention, the at least one third antenna radiator 700 may be included in a sub board electrically connected to the main board 500.

In accordance with an embodiment of the present invention, the sub board 7001 may have a shape divided into a plurality of parts 7111, 7121, and 7131.

In accordance with an embodiment of the present invention, the at least one first antenna radiator 620 may be attached to a non-conductive member (e.g., a carrier 610) fixed to the housing 310.

In accordance with an embodiment of the present invention, at least one portion of the feed part 520 may pass through the non-conductive member (e.g., the carrier 610).

In accordance with an embodiment of the present invention, the non-conductive member (e.g., the carrier 610) may not overlap the main board 500.

In accordance with an embodiment of the present invention, the at least one second antenna radiator 310-20 may not overlap the feed part 520.

In accordance with an embodiment of the present invention, the at least one second antenna radiator 310-20 or 310-30 may be disposed inside or outside of the housing.

In accordance with an embodiment of the present invention, the at least one second antenna radiator may constitute at least one portion of the housing 310 and include at least one of a plurality of separated metal parts 310-20, 310-21, and 310-22.

In accordance with an embodiment of the present invention, the at least one second antenna radiator may include at least one metal part 1401 or 1403 that is fixed to an injection-molded plastic part when the housing 330 is shaped through insert injection molding.

In accordance with an embodiment of the present invention, the at least one second antenna radiator formed by 1411, 1413, 1415, and 1417 may have a closed-loop.

In accordance with an embodiment of the present invention, the at least one second antenna radiator formed by 1421, 1423, and 1425 may include a plurality of slots.

In accordance with an embodiment of the present invention, the housing may includes a front case 1210 disposed at a front side of the electronic apparatus 200; and a rear case 1220 disposed at a rear side of the electronic apparatus 200 and coupled to the front case 1210.

In accordance with an embodiment of the present invention, the at least one second antenna radiator 1330 may be disposed inside or outside of the front case 1210 of the housing.

In accordance with an embodiment of the present invention, the at least one second antenna radiator 1330 may be disposed inside or outside of the rear case 1220 of the housing.

In accordance with an embodiment of the present invention, the at least one first connection member 130-11 or the at least one second connection member 130-13 includes at least one of a conductive tape, a C-clip, a pogo-pin, and solder.

An electronic apparatus includes at least one metal part on a housing that forms an appearance of the electronic apparatus, and thereby it is beneficial to improve the appearance and strength thereof. Also, the at least one part may be used as an antenna device, and thereby it is beneficial to ensure a performance at a corresponding frequency band.

While the invention has been shown and described with reference to certain embodiments thereof, it will be understood by those skilled in the art that various changes in form and details may be made therein without departing from the spirit and scope of the present invention as defined by the appended claims. Therefore, the scope of the present invention is defined not by the detailed description of the invention but by the appended claims and their equivalents, and all differences within the scope will be construed as being included in the present invention.

What is claimed is:

1. An electronic apparatus, comprising:

a first antenna electrically connected to a feeding portion of a first printed circuit board (PCB);

a second antenna separated from the first antenna and electrically coupled with the first antenna; and a conductive member forming at least a portion of a periphery of the electronic apparatus, the conductive member including at least one first portion electrically connecting the second antenna to a ground surface of the first PCB, and at least one second portion separated from the at least one first portion.

2. The electronic apparatus of claim 1, wherein the second antenna at least partly overlaps the first antenna.

3. The electronic apparatus of claim 1, wherein the at least one second portion is electrically decoupled from the first antenna.

4. The electronic apparatus of claim 1, wherein the conductive member is constructed as part of a case frame forming an exterior of the electronic apparatus.

5. The electronic apparatus of claim 1, further comprising:

a third antenna electrically connected to the ground surface of the first PCB, and separated from the first antenna, the second antenna and the conductive member.

6. The electronic apparatus of claim 5, wherein the first antenna is at least partially disposed between the second antenna and the third antenna.

7. The electronic apparatus of claim 5, wherein the third antenna is includes in a second PCB electrically connected with the first PCB.

8. The electronic apparatus of claim 7, wherein the second PCB is associated with a key input device.

9. The electronic apparatus of claim 1, wherein the second antenna is disposed adjacent to the at least one first portion of the conductive member.

10. The electronic apparatus of claim 1, wherein the at least one first portion is a single, substantially linear segment having opposite ends, and is separated from the at least one second portion by a space at each of the opposite ends.

11. The electronic apparatus of claim 10, wherein each of the opposite ends of the least one first portion is connected to the second antenna and to the ground surface of the first PCB.

12. The electronic apparatus of claim 1, further comprising:

a connection means electrically connecting the at least one first portion and the second antenna, or the least one first portion and the ground surface of the first PCB.

13. The electronic apparatus of claim 12, wherein the connection means includes at least one conductive tape, a C-clip, a pogo-pin, and solder.

14. The electronic apparatus of claim 1, wherein the second antenna is disposed on a non-conductive member in an interior of the electronic apparatus.

15. The electronic apparatus of claim 14, wherein the non-conductive member includes a recess, and the first antenna is inserted into the recess.

16. The electronic apparatus of claim 1, further comprising:

a window forming a front surface of the electronic apparatus;

a cover forming a rear surface of the electronic apparatus; and a display panel disposed between the window and the cover, wherein the first PCB is disposed between the display panel and the cover, and wherein the conductive member surrounds a space between the window and the cover.

17. The electronic apparatus of claim 16, wherein the second antenna is disposed on the cover.

18. The electronic apparatus of claim 16, further comprising:

a plate extended from the conductive member and disposed between the display panel and the first PCB.

* * * * *